United States Patent [19]

Green

[11] Patent Number: 5,030,324

[45] Date of Patent: Jul. 9, 1991

[54] SEQUENTIAL BLEACHING PROCEDURE USING CHLORINE AND CHLORINE DIOXIDE IN A FIRST CHLORINATION STAGE OF A MULTISTAGE BLEACHING PROCESS

[75] Inventor: Charles E. Green, Westchester, Ohio

[73] Assignee: Champion International Corporation, Stamford, Conn.

[21] Appl. No.: 471,477

[22] Filed: Jan. 29, 1990

[51] Int. Cl.[5] ..... D21C 9/14; D21C 9/147

[52] U.S. Cl. ..... 162/65; 162/66; 162/67; 162/88; 162/89

[58] Field of Search ..... 162/88, 89, 67, 66, 162/65

[56] References Cited

U.S. PATENT DOCUMENTS 3,433,702 3/1969 Jack et al. ..... 162/88

OTHER PUBLICATIONS

Bugajer et al., "A Comparison Between Bleaching Sequences with Alkaline Extraction in the Presence of Oxidizing Agents", *Pulp & Paper Canada*, 88:12, (1987), p. 169–172.

*Primary Examiner*—Steve Alvo

*Attorney, Agent, or Firm*—Evelyn M. Sommer

[57] ABSTRACT

An improved process for bleaching cellulosic pulp in a first chlorination stage of a multi-stage bleaching process is provided, which involves an improved process for bleaching cellulosic pulp in a first chlorination stage of a multi-stage bleaching process, comprising: (a) admixing cellulosic pulp with a first chlorine dioxide charge and reacting the cellulosic pulp and said chlorine dioxide for a period of time ranging from about 1 second to about 10 minutes; (b) admixing the cellulosic pulp effluent obtained after step (a) wtih chlorine and chlorine dioxide and reacting the thus-obtained cellulosic pulp for a period of time ranging from 1 second to about 10 minutes; and then (c) admixing the cellulosic pulp effluent obtained after step (b) with a second chlorine dioxide charge and reacting the thus-obtained cellulosic pulp effluent for a period of time ranging from about 1 second to about 10 minutes, wherein the pH of the reaction mixture is maintained throughout the bleaching process at from about 5.0 to about 1.0, the temperature is maintained at from about 70° to about 200° C., and from about 10% to about 100% of total available chlorine is added as chlorine dioxide. The supply of chlorine dioxide can be varied for a particular process or mode of operation by causing up to substantially all of the chlorine dioxide to be supplied in the first chlorination stage to be supplied to the first and/or second and/or third step. It is also possible to regulate the process in order that the total available chlorine for the first stage is supplied as chlorine dioxide.

4 Claims, 1 Drawing Sheet

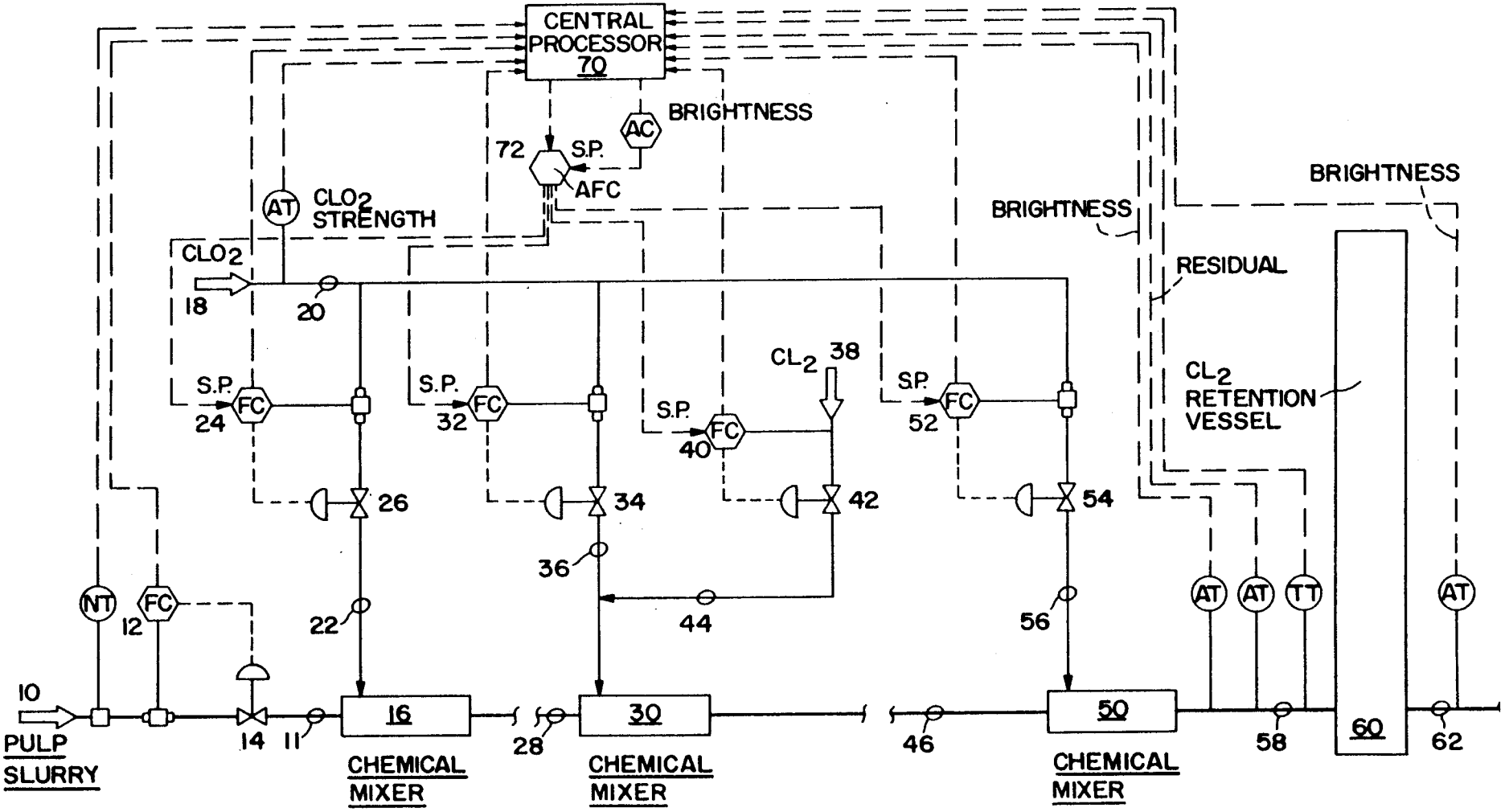
BRIGHTNESS
RESIDUAL
$CL_2$ RETENTION VESSEL
BRIGHTNESS
BRIGHTNESS
CENTRAL PROCESSOR 70
AC
S.P.
AFC
72
$CLO_2$ STRENGTH
AT
$CLO_2$
18
20
S.P.
FC
24
26
22
16
CHEMICAL MIXER
14
11
FC
12
NT
10
PULP SLURRY
S.P.
FC
32
34
36
30
CHEMICAL MIXER
28
$CL_2$
38
S.P.
FC
40
42
44
S.P.
FC
52
54
56
50
CHEMICAL MIXER
46
AT
AT
AT
TT
58
60
62

SEQUENTIAL BLEACHING PROCEDURE USING CHLORINE AND CHLORINE DIOXIDE IN A FIRST CHLORINATION STAGE OF A MULTISTAGE BLEACHING PROCESS

BACKGROUND OF THE INVENTION

1. Field of the Invention

This invention relates to an improved method of bleaching cellulosic pulp in a first chlorination stage of a multistage bleaching process. More particularly, the invention relates to a method of bleaching cellulosic pulp in the first chlorination stage of a multistage bleaching process, using chlorine and chlorine dioxide, wherein the chlorine dioxide charge is split in a manner such that the total amount of environmentally unfavorable by-products can be reduced, without any significant impairment of the cost effectiveness and bleaching results.

2. Description of the Prior Art

The bleaching of cellulosic materials, particularly woodpulp, has in the past been the subject of extensive study and experimentation. As a result, numerous processes for bleaching cellulosic materials are known and used in commercial paper making operations. The more common processes employ more than one reagent and more than one bleaching step in the bleaching operation. Some of these multistep processes involve, for example, treating the cellulosic pulp with a reagent such as chlorine, washing the residual chlorine and solubilized impurities from the treated pulp with water, extracting the chlorinated lignins with caustic and washing with water, treating the cellulosic pulp with another bleaching agent, such as chlorine, chlorine dioxide or sodium hypochlorite and again washing the residual reagent and solubilized impurities from the treated cellulosic pulp. Many variations on the multistage bleaching process are well known.

The first stage of a multi-stage bleaching process for cellulosic pulp (sometimes hereinafter referred to as "the first chlorination stage") is intended to remove residual lignin and other impurities from the pulp. Various oxidizing agents, including chlorine and chlorine dioxide or mixtures thereof have heretofore been employed in this first chlorination stage for the purpose of removing the lignins and other impurities remaining in the woodpulp after digestion. For example, it has previously been suggested in U.S. Pat. No. 3,536,577 to effect the bleaching of cellulosic materials, including woodpulp, using an aqueous solution of chlorine dioxide and chlorine at moderate temperatures. It has also been found that the characteristics of the pulp bleached by the latter process can be improved by the sequential application of chlorine and chlorine dioxide, rather than applying a mixture of the two. These processes are described, for example, in U.S. Pat. Nos. 3,433,702 and 3,501,374. More recently, it had been found that the efficiency of delignification of the bleached pulp could be improved if part of the chlorine is included with the chlorine dioxide in the first step of a bleaching application, followed by application of aqueous chlorine without an intermediate washing. See U.S. Pat. No. 4,432,598.

The bleaching of cellulosic pulp with bleaching agents including chlorine increasingly uses chlorine dioxide as a replacement for some of the chlorine. This is, in major part, because chlorine dioxide is considered to be less harmful to the environment. Chlorinated organic compounds are generated during pulp bleaching with chlorine or chlorine containing compounds. In particular, certain potentially toxic compounds, including tetrachloro-pdibenzodioxin (TCDD) and tetrachlorodibenzofuran (TCDF), (sometimes also referred to as dioxins) as well as Absorbable Organic Halides (AOX) are formed by the chlorination of their precursors, which are typically found in pulp mills. When chlorine in the first stage of bleaching is replaced by an equivalent amount of chlorine dioxide, the production of chlorinated dioxins, along with other chlorinated compounds is decreased.

The current trend is to express organically bound chlorine as AOX rather than TOCL (total organically bound chlorine). The difference in the two methods of expressing organically bound chlorine is in the analytical procedure. TOCL has all of the volatile chlorinated organic compounds removed before analysis, whereas AOX includes both the volatile and non-volatile chlorinated compounds. Consequently, AOX is almost always larger than TOCL. The ratio of AOX to TOCL is quite variable and appears to depend upon the type of pulp, whether or not oxygen delignification has been used, the bleaching process used, and other factors. The ratio generally is 1.0 to 1.4.

AOX appears to be a linear function of the total elemental chloride consumed. Individual chlorinated organic compounds such as TCDD and TCDF exhibit more complicated (curvilinear) relationships. Thus it cannot be assumed that a change in AOX will result in a corresponding change in TCDD and TCDF. AOX essentially measures high molecular weight material and therefore is a "relatively blunt" instrument for monitoring and controlling the discharge of bioaccumulating and toxic persistent substances.

In the aforementioned processes, wherein an amount of chlorine is substituted with chlorine dioxide, chlorine dioxide is generally added ahead of the chlorine (D/C) in the first chlorination stage at substitution levels of 30% or higher. This sequence of chlorine addition had been found to give the most economic bleaching response. Recently, it has been reported, however, that the formation of TCDD and TCDF can be minimized if chlorine is added ahead of the chlorine dioxide (C/D), even though this sequence of addition is not particularly cost effective. The trend of increasing substitution has, on an overall basis, resulted in an increase in the total cost of the bleached pulp. Thus, while each of these methods has certain advantages and disadvantages, it has not been possible to optimally utilize the bleaching chemicals chlorine and chlorine dioxide, to reduce the amount of environmentally unfavorable by-products such as chlorinated dioxins, while at the same time minimizing the impairment in cost effectiveness and bleachability.

Accordingly, it is an object of the present invention to provide a method of bleaching cellulosic pulp in a first chlorination stage using chlorine and chlorine dioxide which maximizes the reduction of environmentally unfavorable by-products formed in a multi-stage bleaching process, without substantially reducing bleachability and cost effectiveness.

Another object of the present invention is to provide a method of bleaching cellulosic pulp in a first chlorination stage which involves splitting the charge of total chlorine into three separate charges.

A still further object of the present invention is to provide an improved method of bleaching cellulosic pulp in the first chlorination stage of a multi-stage bleaching process which includes splitting the charge of chlorine dioxide so that chlorine dioxide is added to the pulp both before and after the addition of the chlorine, thereby effecting a reduction in the amount of environmentally unfavorable by-products compared to knows sequences of chlorine and chlorine dioxide addition in a first chlorination stage.

Other objects and advantages of the invention will become apparent upon reading the following detailed description and appendec claims, and upon reference to the accompanying drawings.

SUMMARY OF THE INVENTION

These as well as other objects and advantages are obtained in accordance with the present invention, which provides an improved process for bleaching cellulosic pulp in a first chlorination stage of a multi-stage bleaching process, comprising: (a) admixing cellulosic pulp with a first chlorine dioxide charge and reacting the cellulosic pulp and said chlorine dioxide for a period of time ranging from about 1 second to about 10 minutes; (b) admixing the cellulosic pulp effluent obtained after step (a) with chlorine and chlorine dioxide and reacting the thus-obtained cellulosic pulp for a period of time ranging from 1 second to about 10 minutes; and then (c) admixing the cellulosic pulp effluent obtained after step (b) with a second chlorine dioxide charge and reacting the thus-obtained cellulosic pulp for a period of time ranging from about 1 second to about 10 minutes, wherein the pH of the reaction mixture is maintained throughout the bleaching process at from about 5.0 to about 1.0, and the temperature is maintained at from about 70° to about 200° F.

This sequence of chlorine dioxide addition, sometimes hereinafter represented by the notation D/C+D/D, splits the total amount of chlorine dioxide to be added in the first chlorination stage, such that chlorine dioxide is added both before and after the chlorine charge, which also includes an amount of the chlorine dioxide. This sequence of addition in the first chlorination stage is capable of decreasing the total amount of environmentally incompatible by-products generated in a multi-stage pulp bleaching process compared to other known first chlorination stage sequences of addition.

BRIEF DESCRIPTION OF THE DRAWING

For a more complete understanding of this invention reference should now be made to the embodiment illustrated in a greater detail in the accompanying drawing and described below by way of examples of the invention.

The drawing is a schematic illustration of one embodiment of the sequence of chlorine dioxide and chlorine addition in a first chlorination stage of a multi-stage bleaching process in accordance with the present invention.

DETAILED DESCRIPTION OF THE INVENTION

The process of the present invention is applicable to any cellulosic fibrous material in general, but is described with particular reference to the bleaching of woodpulp, such as that obtained from pine, hemlock, spruce, Douglas fir, balsam, cedar and the like. The woodpulp is generally first prepared by any of the known processes, such as the Kraft process or processes which use sodium sulfide or in which aqueous sodium sulfide is produced as an intermediate product, wherein the wood is pulped with partial removal of the lignin. Typical of the latter processes are high yield pretreatment Kraft, polysulfide, alkafide and sodium-based sulfide processes. In addition to partially removing the lignins, such processes also more completely expose the fibers, thus providing more complete contact between the fibers and the bleaching chemicals. Delignification with oxygen is sometimes, although not necessarily, practiced prior to the first chlorination stage. By using oxygen alkali treatment, the consumption of active chlorine in the subsequent chlorination stages can be reduced, which allows for a savings in production costs and also for a cut in the load of chlorinated compounds in the bleaching effluents.

The bleaching chemicals employed in the first chlorination stage of the present invention are reagents which act upon impurities such as color bodies and lignin contained in the woodpulp, thereby oxidizing or solubilizing the impurities so that they can be removed or whitened. Chlorine dioxide and chlorine, as gases, can be used to react either on dry or wet cellulosic material. In addition, the chlorine dioxide and chlorine can be passed into an aqueous dispersion of the pulp or the like to react with the cellulosic material therein or they can be absorbed in aqueous solutions and added to the pulp in solution form. It is generally preferable to have the pulp in an aqueous slurry and to add the chlorine dioxide and chlorine in solution to the slurry. Since in commercial operations chlorine dioxide may contain a small amount of chlorine due to the release of chlorine during most chlorine dioxide generation processes, when it is stated that the cellulosic pulp is treated with chlorine dioxide, such a treatment is with a material which is substantially chlorine dioxide but may contain some chlorine. In the same fashion, the chlorine employed is substantially all chlorine, but may additionally contain some chlorine dioxide.

Referring now to the drawing which is a schematic illustration of a preferred embodiment of the invention, a woodpulp prepared from any of the known digestion processes is supplied to brown washers (not shown), where the pulp is washed and then conducted in sequence to a high density storage tower (not shown) and to a blend chest (also not shown), where the consistency of the pulp mixture is regulated to produce a pulp slurry 10. The process of the present invention can be applied to cellulose pulp of varying pulp consistency. In accordance with a preferred embodiment, the pulp slurry 10 generally has a consistency of from about 1.0% to about 15.0% by weight of the woodpulp, and preferably about 3% by weight of the pulp.

The pulp slurry 10 is then pumped from the blend chest into a first chemical mixer 16 via a line 11. A flow controller 12 can be provided to regulate the flow of pulp slurry 10 through a valve 14 into the first mixer 16, thereby providing a means for regulating the amount of pulp slurry 10 present in the system at any given time.

A first charge of chlorine dioxide also can be fed into mixer 16 from a chlorine dioxide source 18 through lines 20 and 22. The chlorine dioxide in source 18 can be prepared by any of the conventional processes for chlorine dioxide production and typically has a concentration ranging from about 4 grams per liter to about 12 grams per liter. A flow controller 24, which is capable of receiving a signal from a central processing unit 70 via an analytical ratio controller 72, is provided to regulate the flow of chlorine dioxide through a valve 26 and into the first chemical mixer 16. The central processor 70 receives signals from the analytical transmitters which measure the physical components of the pulp slurry 10. The central processor 70 methodically examines these inputs and determines the compensated brightness and percent chlorine in the pulp. These values are used to transmit instructions to the flow controllers 24, 32, 40 and 52 via the analytical ratio controller 72. These instructions will regulate the application of chlorine and chlorine dioxide to the extent that either charge can be varied for a particular process mode of operation by the control of valves 26, 34, 42, 54, or any combination hereof.

This flow control process enables the regulation of the amount of total available chlorine added as chlorine dioxide to the first chemical mixer 16 for reaction therein with the pulp slurry 10.

After the first chlorine dioxide addition, the pulp slurry 10 is mixed with the chlorine dioxide in the first chemical mixer 16.

The thus-treated pulp slurry is then passed via a line 28 to a second chemical mixer 30. Line 28 is of sufficient length so as to provide a reaction time of 1 second to about 10 minutes, and preferably for about 30 seconds.

A charge of chlorine from a chlorine source 38 is fed, via a line 44 into a line 36, wherein the chlorine is admixed with a charge of chlorine dioxide from the chlorine dioxide source 18 via line 20. The chlorine in source 38 may be obtained from any convenient source and/or prepared by any of the conventional processes of chlorine production. Typically, the chlorine stream has a concentration ranging from about 95 to about 100%. The chlorine and chlorine dioxide are fed into the second chemical mixer 30 via the line 36, wherein they are admixed with the treated pulp slurry effluent from the first chemical mixer 16. The flow of chlorine into the second chemical mixer is regulated by a flow controller 40 and valve 42, with the flow controller 40 capable of receiving a signal from the central processing unit 70 via the analytical ratio controller 72. The flow of the chlorine dioxide into the second chemical mixer is similarly regulated by a flow controller 32 and a valve 34, with the flow controller 32 also capable of receiving a signal from the central processing unit 70 through the analytical ratio controller 72.

The thus-treated pulp slurry is then passed, via a line 46, to a third chemical mixer 50. Line 46 is of sufficient length so as to provide a reaction time of 1 second to about 10 minutes, and preferably about 30 seconds.

A charge of chlorine dioxide is added from the chlorine dioxide source 18 via line 20 and a line 56. A flow controller 52, which is capable of receiving a signal from the central processing unit 70 via the analytical ratio controller 72, is provided to regulate the flow of chlorine dioxide through a valve 54 and into the third chemical mixer 50.

The reaction time following the third chemical mixer is allowed to proceed in line 58 for a predetermined period of time, from about 1 second to about 60 seconds, and preferably for about 30 seconds.

The pulp slurry is conveyed, via line 58, to a retention vessel 60, in which bleaching is continued for a period of between 5 and 90 minutes, suitably between 20 and 60 minutes and preferably from 30 to 45 minutes.

In an alternative embodiment, not shown, the chemical mixers could permit the multiple applications utilizing axial, radial, and transverse points of addition which may span a period of time up to 1 minute.

Analytical transmitters are provided in the system. These analytical transmitters are unattended devices that monitor a process stream for one or more physical components of the stream.

The process of the present invention is described in terms of a continuous process, wherein there is a continuous flow of pulp slurry and chemical reagents in the system, however, the process is considered equally applicable to batch operations.

The amount of total available chlorine added in the foregoing sequential addition, added as both chlorine and chlorine dioxide, can vary considerably, depending upon the particular characteristics desired to be obtained as a result of the bleaching operations. Normally, about 1.0 to about 8.0% and preferably about 3 to 6% of total available chlorine, by weight of the dry wood pulp, is added to the wood pulp in the first chlorination stage of the present invention. The term "total available chlorine" is used herein in its normal meaning in the bleaching art, and refers to the total bleaching power of the solution, chlorine dioxide having a bleaching power which is 2.63 times that of chlorine on a weight basis.

In accordance with the present invention, from about 10 to about 100% of the total available chlorine is added as chlorine dioxide in the first chlorination stage. The remaining 90 to 0% of total available chlorine in the first chlorination stage is added as elemental chlorine in the second chemical mixer. The charge of chlorine dioxide is split, such that predetermined amounts of chlorine dioxide are added at the first and third chemical mixers, and a predetermined amount of chlorine dioxide is added with the chlorine charge at the second chemical mixer.

The bleaching time for each of the bleaching chemicals employed in the process of this invention can also vary considerably, depending upon the bleaching temperature, concentration of the reagents used, the specific desired characteristics of the bleached pulp and the percentage pulp dispersed in the aqueous solution. Sufficient time is provided after each chemical addition so that the bleaching chemical is reacted with the cellulosic material. At lower temperatures and lower concentrations of bleaching chemical, when the ultimate bleaching capacity of the chemical is to be utilized, longer bleaching times are used.

The total bleaching or reaction time for the first chlorination stage of the present invention can range from about 5 minutes to about 60 minutes. Preferably, the reaction time will range from about 30 minutes to about 45 minutes and most preferably, about 35 to 40 minutes. As will be recognized by those of skill in the art, the distance between each chemical mixer and the size of the retention vessel can be manipulated so that the appropriate amount of time is available for the desired chemical reaction.

The temperature of the reaction mixture may vary during the bleaching process and is dependent upon several other parameters, particularly time. The temperature of the reaction mixture during the bleaching operation is normally maintained at from about 70° to about 200° F., and preferably, at about 135° F. The pH of the reaction mixture is maintained throughout the bleaching process at from about 5.0 to about 1.0, preferably about 2.9.

Following the completion of the first chlorination stage, the pulp passes by a line 62 to the remainder of the multi-stage bleaching and caustic extraction operations, wherein the pulp is subjected to conventional EDED (E=caustic extraction; D=chlorine dioxide bleaching) steps. Various reagents well known to those in the art can be used in the caustic extraction steps, including sodium hydroxide solution, oxygen, hydrogen peroxide, and the like, with sodium hydroxide solution being the preferred extraction agent. Intermediate washings with water can be effected between each chemical application step. In a preferred embodiment, oxidative extraction with caustic and oxygen is effected in the first extraction step and the subsequent DED steps have no intermediate washings.

The present invention will be more clearly understood from the following specific examples. Unless otherwise stated, all percentages and parts are by weight.

EXAMPLE 1 AND COMPARATIVE EXAMPLES 2-4

These examples illustrate a comparison between the results obtained by the sequential D/(C+D)/D addition in the first chlorination stage of the present invention at 50% substitution (Example 1) compared to a two step sequential addition of D/(C+D) in the first chlorination stage (Comparative Example 2), a single addition of (C+D) in a first chlorination stage (Comparative Example 3) and a two step sequential addition of (C+D)/D in a first chlorination stage (Comparative Example 4), each also at 50% substitution. The examples were each run in a three-stage bleaching operation, wherein the first chlorination stage of Example 1 represents the process of the present invention, the first chlorination stage of Comparative Example 2 involved a sequential addition of chlorine dioxide and then a mixture of chlorine and chlorine dioxide, Comparative Example 3 utilized a single charge of a mixture of chlorine and chlorine dioxide and Comparative Example 4 utilized a sequential addition of a mixture of chlorine and chlorine dioxide and then chlorine dioxide. The remaining bleaching stages for the Examples follow the same sequence of caustic extraction with sodium hydroxide solution and chlorine dioxide addition.

Each of the Examples was run using Pensacola softwood oxygen pulp having a Kappa number of 15.1, as measured by TAPPI procedure T-236, viscosity of 16.9 cp, as measured by TAPPI method T-230 and a Kappa factor* of 0.2. Total available chlorine in the first chlorination stage was 3.02%. Bleaching was conducted using pulp slurry at 3% consistency for a total of 21 minutes at 135° F. A washing efficiency of 90% was maintained in the first chlorination stage.

*Kappa factor=Total equivalent chlorine applied in the chlorination stage as % Kappa number of unbleached pulp Chlorine and chlorine dioxide were used in the first chlorination stage in the overall proportions of 50% of the total available chlorine being provided by chlorine dioxide and 50% of the total chlorine dioxide being provided as chlorine. The mixing time between the three chemical additions in the first chlorination stage was 30 seconds.

The bleaching sequences, reagents employed and the results obtained in Examples 1-4 are shown in the following Table I.

TABLE I

| ADDITION SEQUENCE | EXP. 1 | % CHEMICAL ADDITION COMP. EXP. 2 | COMP. EXP. 3 | COMP. EXP. 4 |
|---|---|---|---|---|
| 1. D | 30 | 45 | — | — |
| 2. C + D | 50 + 5 | 50 + 5 | 50 + 50 | 50 + 5 |
| 3. D | 15 | — | — | 45 |
| CHLORINATION STAGE | | | | |
| Total Chlorine, % | 3.02 | 3.02 | 3.02 | 3.02 |
| Chlorine as elemental $Cl_2$,% | 1.51 | 1.51 | 1.51 | 1.51 |
| Chlorine as $ClO_2$,% | 1.51 | 1.51 | 1.51 | 1.51 |
| $ClO_2$ as $ClO_2$,% | 0.57 | 0.57 | 0.57 | 0.57 |
| pH | 2.6 | 2.6 | 2.6 | 2.6 |
| AOX[3], lbs./ADBT[2] | 2 | 2.21 | 2.27 | 2.24 |
| EXTRACTION STAGE | | | | |
| Caustic applied, % | 1.35 | 1.35 | 1.35 | 1.35 |
| pH | 11.6 | 11.4 | 11.5 | 11.3 |
| CEK No. 1 | 4.1 | 4 | 4 | 4.1 |
| Brightness, GE[4] | 40.4 | 41.8 | 40.9 | 39.8 |
| Viscosity, cp | 15.8 | 16 | 15.1 | 16.1 |
| TCDD in pulp | — | — | — | — |
| TCDF in pulp | — | — | — | — |
| AOX, lbs./ADBT | 1.33 | 1.28 | 1.32 | 1.15 |
| CHLORINE DIOXIDE STAGE | | | | |
| Chlorine Dioxide applied, % | 1.23 | 1.17 | 1.26 | 1.2 |
| Caustic applied, % | 0.62 | 0.58 | 0.63 | 0.6 |
| Brightness, GE | 82 | 82 | 82 | 82 |
| COST OF BLEACHING, $/ADBT | 18.6 | 18.1 | 18.9 | 18.4 |
| AOX in C and E stage, lbs./ADBT | 3.33 | 3.49 | 3.59 | 3.39 |

1. CEK No. = K. No. after caustic extraction stage
2. ADBT = air dry bleached tons
3. AOX measured by Mitsubishi AOX analyzer
4. Brightness determined by TAPPI METHOD T-452

For 50% substitution, there was no appreciable difference in the cost of bleaching between the different modes of addition of chlorine and chlorine dioxide in the first chlorination stage. The lowest cost was 18.1$/ABDT for the D/(C+D) mode and the highest cost was $18.9/ABDT for the C+D mode. The other modes of addition, D/(C+D)/D and (C+D)/D were in between. The D(C+D) mode had the best brightness development, however, brightness development was not substantially impaired by the D/(C+D)/D mode of addition.

The AOX in the chlorination filtrate was about 10% lower for the D/(C+D)/D mode as compared to the other modes of addition.

The data show that the multiple addition of chlorine and chlorine dioxide in the sequence D/(C+D)/D is effective to reduce the AOX formation in the first chlorination stage as compared to other known modes of addition, without substantial impairment of bleachability or increase in costs when similarly compared to other modes of addition.

The potential of reducing chlorine (to the extent of elimination) in the second mixer is a possibility.

Specific geographic locations will have an influence on the cost of chemicals, including the decision to have on-site manufacturing capability of the chemicals.

What is claimed is:

1. A method for bleaching cellulosic pulp in a multistage bleaching process comprising the steps of:

(a) admixing cellulosic pulp with a first chlorine dioxide charge in a first chlorination stage and reacting the cellulosic pulp and said chlorine dioxide for a predetermined period of time ranging from about 1 second to about 10 minutes;

(b) admixing the cellulosic pulp directly obtained from step (a) with chlorine and chlorine dioxide in the first chlorination stage and reacting the thus-obtained cellulosic pulp for a second predetermined period of time ranging from about 1 second to about 10 minutes; and then (c) admixing the cellulosic pulp effluent obtained after step (b) with a second chlorine dioxide charge in the first chlorination stage and reacting the thus-obtained cellulosic pulp for a third predetermined period of time ranging from about 1 second to about 10 minutes, wherein the pH of the reaction mixture is maintained at from about 5.0 to about 1.0 throughout steps (a)-(c) stage, temperature is maintained at from about 70 to about 200° F. throughout steps (a)-(c) and wherein from about 10 to 50% of total available chlorine is added as chlorine dioxide and the total chlorine dioxide charge is split such that predetermined amounts of the chlorine dioxide are added in steps (a), (b) and (c) and a predetermined amount of chlorine is added in step (b);

(d) subjecting the cellulosic pulp obtained after step (c) to an oxygen extraction stage, wherein the cellulosic pulp is mixed with caustic and oxygen;

(e) subjecting the thus-obtained extracted cellulosic pulp to a first chlorine dioxide stage; thereafter (f) subjecting the cellulosic pulp obtained after step (e) to a caustic extraction stage wherein the extraction agent is sodium hydroxide; and finally (g) subjecting the thus obtained cellulosic pulp to a second chlorine dioxide stage.

2. A method according to claim 1, wherein the total available chlorine in steps (a)-(c) ranges from about 1 to about 8%, based upon the weight of the cellulosic pulp.

3. A method according to claim 1, wherein the admixing is each of steps (a) (b) and (c) is conducted for about 30 seconds.

4. A method according to claim 1, wherein total reaction time for the first chlorination stage, comprising steps (a)-(c), is from about 30 seconds to about 30 minutes.

* * * * *